US012221986B2

(12) United States Patent
Gerhard

(10) Patent No.: US 12,221,986 B2
(45) Date of Patent: Feb. 11, 2025

(54) SIPHON

(71) Applicant: ViESSMANN CLIMATE SOLUTIONS SE, Allendorf (DE)

(72) Inventor: Matthias Gerhard, Bad Berleburg (DE)

(73) Assignee: VIESSMANN CLIMATE SOLUTIONS SE, Allendorf (DE)

( * ) Notice: Subject to any disclaimer, the term of this patent is extended or adjusted under 35 U.S.C. 154(b) by 0 days.

(21) Appl. No.: 18/037,629

(22) PCT Filed: Dec. 14, 2021

(86) PCT No.: PCT/DE2021/101002

§ 371 (c)(1),
(2) Date: May 18, 2023

(87) PCT Pub. No.: WO2022/144059

PCT Pub. Date: Jul. 7, 2022

(65) Prior Publication Data

US 2024/0026904 A1 Jan. 25, 2024

(30) Foreign Application Priority Data

Dec. 28, 2020 (DE) ..... 10 2020 134 940.8

(51) Int. Cl.
*F04F 10/00* (2006.01)

(52) U.S. Cl.
CPC ..... *F04F 10/00* (2013.01); *Y10T 137/2713* (2015.04); *Y10T 137/5907* (2015.04)

(58) Field of Classification Search
CPC ..... F04F 10/02; F04F 10/00; Y10T 137/2761; Y10T 137/2829; Y10T 137/2863;
(Continued)

(56) References Cited

U.S. PATENT DOCUMENTS 1,711,270 A * 4/1929 Litle, Jr. ..... F25B 41/37 138/42
1,950,227 A * 3/1934 Chevalier ..... F16T 1/34 137/177

(Continued)

FOREIGN PATENT DOCUMENTS

| | | |
|---|---|---|
| AT | 388 200 B | 5/1989 |
| DE | 804 667 C | 4/1951 |
| DE | 101 01 115 A1 | 7/2001 |

OTHER PUBLICATIONS

International Preliminary Report on Patentability in PCT/DE2021/101002, mailed Apr. 7, 2022.

(Continued)

*Primary Examiner* — Craig J Price
(74) *Attorney, Agent, or Firm* — Collard & Roe, P.C.

(57) ABSTRACT

A siphon includes a feed area for feeding a liquid, a downpipe connecting to the feed area, extended from top to bottom in a use position of the siphon, a deflection pipe filled with liquid during stationary operation on the end of the downpipe facing away from the feed area connecting to this, a riser pipe on the end of the deflection pipe facing away from the downpipe, and connecting to this, extended from bottom to top in the use position, and a discharge area connecting to the end of the riser pipe facing away from the deflection pipe for discharging liquid. A storage tank arranged on the siphon between the feed area and the discharge area is hydraulically connected to the deflection pipe and designed to automatically fill with liquid during stationary operation and to automatically empty into the deflection pipe following a pressure surge affecting the siphon.

8 Claims, 1 Drawing Sheet

(58) Field of Classification Search
CPC ..... Y10T 137/2713–2924; Y10T 137/5907; E03F 5/20; E03C 1/28; E03C 1/304; F16T 1/34; F24H 8/006
USPC ..... 137/123, 130, 314; 126/110 R, 116 R, 126/99 D
See application file for complete search history.

(56) References Cited

U.S. PATENT DOCUMENTS

| | | | | | |
|---|---|---|---|---|---|
| 5,309,890 | A * | 5/1994 | Rieke | F24H 8/006 | 137/247.27 |
| 5,379,749 | A * | 1/1995 | Rieke | F24H 8/006 | 137/247.27 |
| 5,469,879 | A * | 11/1995 | Rasmussen | F16T 1/00 | 137/392 |
| 5,704,343 | A | 1/1998 | Ahn et al. | | |
| 8,826,901 | B2 * | 9/2014 | Haydock | F24H 3/105 | 165/170 |
| 10,865,996 | B2 * | 12/2020 | Joyner, Jr. | F16T 1/34 | |
| 11,592,207 | B2 * | 2/2023 | Park | F24H 9/2085 | |
| 2013/0025039 | A1 | 1/2013 | Armstrong | | |

OTHER PUBLICATIONS

International Search Report in PCT/DE2021/101002, mailed Apr. 7, 2022.
Wikipedia, "Odour trap", Last edited Apr. 30, 2023, with English Translation, total of 6 pages, https://de.wikipedia.org/w/index.php?title=Geruchsverschluss&01did=200508878.

* cited by examiner

SIPHON

CROSS REFERENCE TO RELATED APPLICATIONS

This application is the National Stage of PCT/DE2021/101002 filed on Dec. 14, 2021, which claims priority under 35 U.S.C. § 119 of German Application No. 10 2020 134 940.8 filed on Dec. 28, 2020, the disclosure of which is incorporated by reference. The international application under PCT article 21(2) was not published in English.

BACKGROUND OF THE INVENTION

1. Field of the Invention

The invention relates to a siphon as disclosed herein.

2. Description of the Related Art

A siphon of the type mentioned above is known from document U.S. Pat. No. 5,704,343 A. Such a siphon, which is also called a pipe siphon, consists of a feed area for feeding of a liquid, a downpipe connecting to the feed area extended from top to bottom in the position of use of the siphon, a deflection pipe filled with liquid during stationary operation on the end of the downpipe facing away from the feed area and connecting to this, a riser pipe on the end of the deflection pipe facing away from the downpipe connecting to this and extended from bottom to top in the position of use of the siphon, and a discharge area connected to the end of the riser pipe facing away from the deflection pipe for discharging the liquid.

SUMMARY OF THE INVENTION

The invention is based on the object of improving a siphon of the type mentioned above. In particular, a reliable blow-out protection is to be created on a pipe siphon that is robust against blockages.

This task is achieved with a siphon of the type mentioned above by the features disclosed herein.

According to the invention, it is thus provided that, on the siphon between the feed area and the discharge area, a storage tank is arranged, which is hydraulically connected to the deflection pipe, is designed to automatically fill with the liquid during stationary operation and to automatically empty into the deflection pipe following a pressure surge that affects the siphon.

In other words, thereby, the siphon according to the invention is characterized in that a storage tank is provided on the siphon, which is used to store an additional amount of liquid, which is used to replace liquid lost in the event of a pressure surge or is used to refill the siphon. The size of the storage tank is preferably dimensioned in such a way that at least one pressure surge can be compensated.

Other favourable further developments of the siphon according to the invention are also disclosed.

For the sake of completeness, reference is made to so-called bottle siphons (see, for example, the Wikipedia article "Odour trap"), but they clog much faster than pipe siphons and are therefore unsuitable for certain applications.

In addition, reference is also made to the further solution according to the patent document DE 101 01 115 A1.

BRIEF DESCRIPTION OF THE DRAWINGS

The siphon according to the invention including its favourable further developments is explained in more detail below on the basis of the drawing of a preferred exemplary embodiment.

The figures show.

DETAILED DESCRIPTION OF THE DRAWINGS

Figure 1:
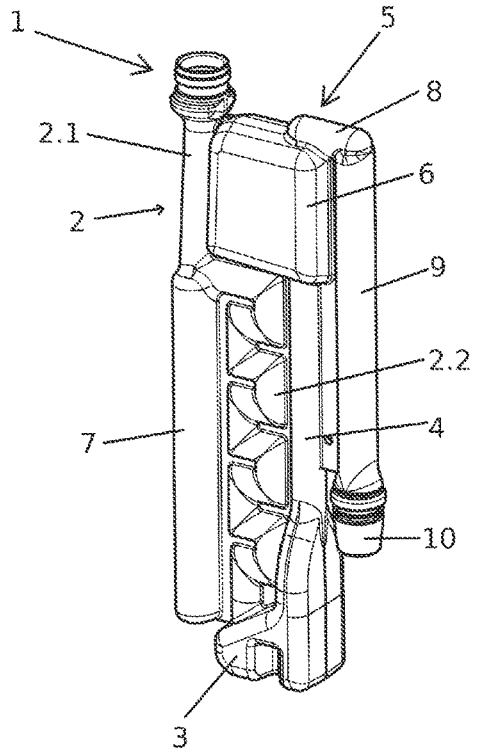
FIG. 1 perspectively, the siphon according to the invention.
Figure 2:
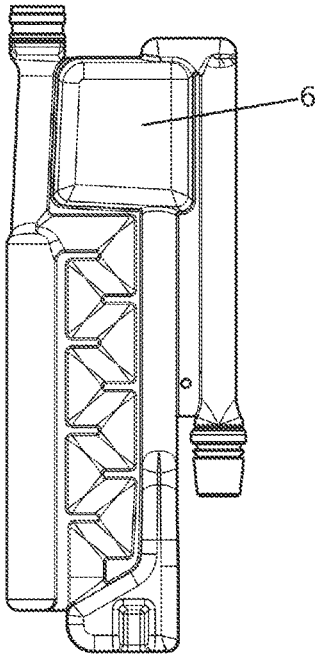
FIG. 2 in a top view, the siphon in accordance with FIG. 1.
Figure 3:
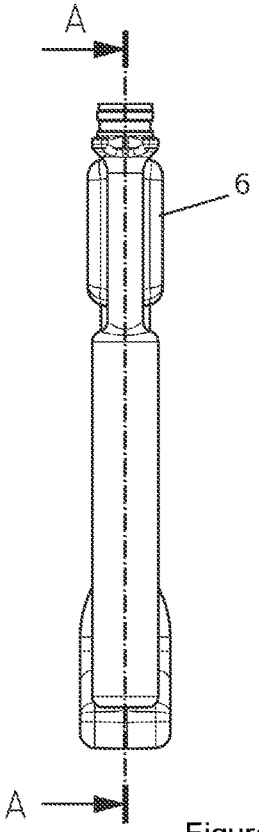
FIG. 3 in a side view of the siphon in accordance with FIG. 1.
Figure 4:
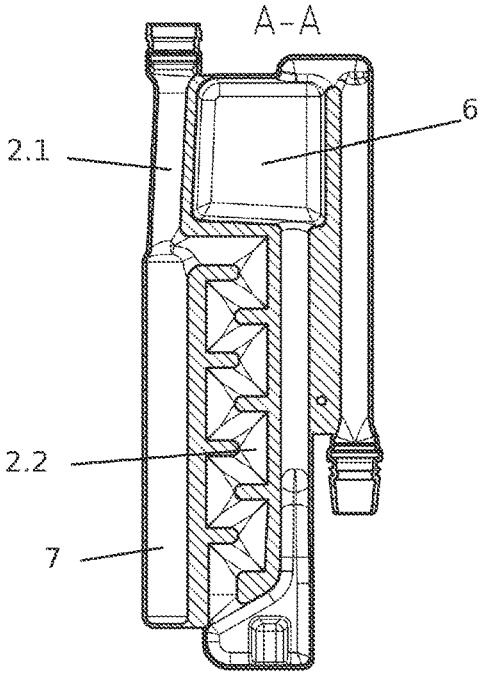
FIG. 4 in a sectional view, the siphon in accordance with FIG. 1, along the cutting line A-A in FIG. 3.

The siphon shown in the figures, which is intended, in particular, for an oil- or gas-powered boiler, consists in a manner known per se of a feed area 1 for feeding a liquid, a downpipe 2 connecting to the feed area 1, extended from top to bottom in the position of use of the siphon, a deflection pipe 3 filled with liquid during stationary operation on the end of the downpipe 2 facing away from the feed area 1 and connecting to this, a riser pipe 4 on the end of the deflection pipe 3 facing away from the downpipe 2 connecting to this and extended from bottom to top in the position of use of the siphon, and a discharge area 5 connecting to the end of the riser pipe 4 facing away from the deflection pipe 3 for discharging the liquid.

As is immediately evident, in particular, it is preferably provided that the feed area 1 is formed as a pipe connection. Via this pipe connection, the siphon is connected, for example or preferably, at the lower end of an exhaust gas jacket of a boiler.

Furthermore, in particular, it is preferably provided that the siphon is formed in a single piece as a plastic injection-moulded part.

It is now essential for the siphon according to the invention that, at this, between the feed area 1 and the discharge area 5, a storage tank 6 is arranged, which is hydraulically connected to the deflection pipe 3, is designed to automatically fill with the liquid during stationary operation and to automatically empty into the deflection pipe 3 following a pressure surge that affects the siphon. As explained at the beginning, this provision of the invention serves to ensure that the siphon can refill itself at least once, preferably a plurality of times, after a pressure surge, as it repeatedly occurs, in particular, in the case of heating systems.

Being particularly preferred, it is provided that the storage tank 6 is arranged on the riser pipe 4.

Furthermore, it is preferably provided that the storage tank 6 is formed from a spatial expansion of the riser pipe 4, meaning, the riser pipe 4 and the storage tank 6 materially merge into each other.

In addition, it is preferably provided that the storage tank 4 is arranged closer to the discharge area 5 than to the deflection pipe 3.

For a particularly compact design, it is also preferably provided that the storage tank 6 is rectangular.

Furthermore, being particularly preferred, it is provided that the downpipe 2 starting from the feed area 1 comprises a first, straight downpipe section 2.1 and a second downpipe section 2.2 adjoining it and running in a meander-like manner, connected to the deflection pipe 3. The meander shape is chosen to counteract a possible pressure surge with more friction. For this purpose, it is also preferably provided that the second, meander-like downpipe section 2.2 comprises at least three horizontal and three vertical intermediate sections when the siphon is operated as intended. Furthermore, it is preferably provided in this context that the downpipe section 2.2 is angled by 90° at transitions between the horizontally and vertically running intermediate sections.

In addition, as can be seen from the figures, it is preferably provided that the first downpipe section 2.1 has a length of ⅓ to ½ and the second downpipe section 2.2 correspondingly has a length of ⅔ to ½ of the length of the downpipe 2.

In addition, it is preferably provided that the storage tank 4 is formed in the area of the first downpipe section 2.1 or parallel to this.

In order to be able to intercept contaminants, in particular, alluvial particles, from the exhaust system of the above-mentioned boiler and thus to ensure the longest possible, trouble-free operation, in particular, it is also preferably provided that, at the transition area between the first and second downpipe section 2.1, 2.2, a trap 7 is arranged that is hydraulically connected to the downpipe 2, sealed at its lower end, and extended vertically during the intended use of the siphon. This siphon 7 preferably has a length of 75 to 100% of the length of the second downpipe section 2.2. In addition, it is preferably provided that the trap 7 is designed to adjoin vertically on the first downpipe section 2.1 and the second downpipe section 2.2 is designed to adjoin horizontally on the first downpipe section 2.1.

In order to ultimately be able to connect the siphon with a sewer system, furthermore, an additional deflection pipe 8 is preferably arranged at the discharge area 5. In addition, an additional downpipe 9 is arranged at the end of the additional deflection pipe 8 facing away from the discharge area that begins there and runs vertically downwards during the intended operation of the siphon, wherein, furthermore, a pipe discharge connection 10 is provided on the end of the additional downpipe 9 facing away from the additional deflection pipe 8. Via this pipe outlet connection 10, the siphon is preferably connected to the said sewer system.

| Reference list | |
|---|---|
| 1 | feed area |
| 2 | downpipe |
| 2.1 | first downpipe section |
| 2.2 | second downpipe section |
| 3 | deflection pipe |
| 4 | riser pipe |
| 5 | discharge area |
| 6 | storage tanks |

-continued

| Reference list | |
|---|---|
| 7 | siphon |
| 8 | additional deflection pipe |
| 9 | additional downpipe |
| 10 | pipe discharge connection |

The invention claimed is:

1. A siphon comprising a feed area for feeding a liquid, a downpipe connecting to the feed area, extended from top to bottom in a position of use of the siphon, a deflection pipe filled with the liquid during stationary operation on an end of the downpipe facing away from the feed area connecting to this, a riser pipe on an end of the deflection pipe facing away from the downpipe, and connecting to this, extended from bottom to top in the position of use of the siphon, and a discharge area connecting to an end of the riser pipe facing away from the deflection pipe for discharging the liquid wherein, on the siphon, between the feed area and the discharge area, a storage tank is arranged, which is hydraulically connected to the deflection pipe, is designed to automatically fill with the liquid during stationary operation and to automatically empty into the deflection pipe following a pressure surge that affects the siphon, and wherein the downpipe, starting from the feed area comprises a first, straight downpipe section and a second downpipe section adjoining the first, straight downpipe section and running in a meander-like manner, connected to the deflection pipe and at a transition area between the first, straight downpipe section and the second downpipe section, a trap is arranged that is hydraulically connected to the downpipe, sealed at a lower end of the trap, and extended vertically during use of the siphon.

2. The siphon according to claim 1, wherein the storage tank is arranged on the riser pipe.

3. The siphon according to claim 1, wherein the storage tank is formed from a spatial expansion of the riser pipe.

4. The siphon according to claim 1, wherein the storage tank is located closer to the discharge area than to the deflection pipe.

5. The siphon according to claim 1, wherein the storage tank is rectangular.

6. The siphon according to claim 1, wherein an additional deflection pipe is arranged at the discharge area.

7. The siphon according to claim 6, wherein an additional downpipe is arranged at an end of the additional deflection pipe facing away from the discharge area that begins there and runs vertically downwards during the intended operation of the siphon.

8. The siphon according to claim 7, wherein a pipe discharge connection is provided on an end of the additional downpipe facing away from the additional deflection pipe.

* * * * *